US011353255B2

(12) United States Patent
Hwang et al.

(10) Patent No.: US 11,353,255 B2
(45) Date of Patent: Jun. 7, 2022

(54) REFRIGERATOR

(71) Applicant: SAMSUNG ELECTRONICS CO., LTD., Suwon-si (KR)

(72) Inventors: In-Yong Hwang, Suwon-si (KR); Dong-Won Koo, Suwon-si (KR); Sung Jin Park, Suwon-si (KR); Youn Tae Shin, Suwon-si (KR); Dong Hyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 179 days.

(21) Appl. No.: 16/718,833

(22) Filed: Dec. 18, 2019

(65) Prior Publication Data

US 2020/0200466 A1 Jun. 25, 2020

(30) Foreign Application Priority Data

Dec. 19, 2018 (KR) ..... 10-2018-0165592

(51) Int. Cl.
*F25D 23/00* (2006.01)
*F25D 19/00* (2006.01)
(Continued)

(52) U.S. Cl.
CPC ..... *F25D 23/006* (2013.01); *F25D 11/02* (2013.01); *F25D 19/003* (2013.01); *F25D 23/087* (2013.01); *F25D 2323/002* (2013.01)

(58) Field of Classification Search
CPC ..... F25D 19/02; F25D 23/087; F25D 23/006; F25D 11/02; F25D 19/003; F25D 2323/002
See application file for complete search history.

(56) References Cited

U.S. PATENT DOCUMENTS 6,094,934 A 8/2000 Rand et al.
6,530,231 B1 * 3/2003 Nagy ..... F25B 21/02 136/203
(Continued)

FOREIGN PATENT DOCUMENTS

JP 3099634 8/2000
JP 2008-128516 A 6/2008
(Continued)

OTHER PUBLICATIONS

Machine English Language Translation of JP 3099634 (Year: 2000).*
(Continued)

*Primary Examiner* — Cassey D Bauer
(74) *Attorney, Agent, or Firm* — Staas & Halsey LLP

(57) ABSTRACT

Provided is a refrigerator. The refrigerator includes: a cabinet forming a storage chamber therein and including a cooling module mounting portion, a cabinet sealing portion formed on an outer surface of the cooling module mounting portion; a cooling module detachably mounted to the cooling module mounting portion and including an evaporator, a condenser, and a compressor, wherein the cooling module includes a module housing, and the module housing includes a module sealing portion facing the cabinet sealing portion, and the module sealing portion includes a module inclination portion positioned at an inclination with respect to a direction in which the cooling module is insertable into the cabinet to be mounted to the cabinet; and a sealing member positioned between the cabinet sealing portion and the module sealing portion.

19 Claims, 12 Drawing Sheets

(51) Int. Cl.
*F25D 23/08* (2006.01)
*F25D 11/02* (2006.01)

(56) References Cited

U.S. PATENT DOCUMENTS

| | | | | |
|---|---|---|---|---|
| 2005/0056041 | A1* | 3/2005 | Jin | F25D 19/02 62/302 |
| 2005/0217301 | A1* | 10/2005 | Iguchi | F25D 19/02 62/302 |
| 2011/0146054 | A1* | 6/2011 | Selin | F25D 23/063 29/527.1 |
| 2012/0319551 | A1* | 12/2012 | Ramm | F25D 23/028 312/405 |

FOREIGN PATENT DOCUMENTS

| | | | |
|---|---|---|---|
| JP | 2009-228917 | A | 10/2009 |
| KR | 10-1996-0009016 | B1 | 7/1996 |
| KR | 2003-0027367 | | 4/2003 |
| KR | 10-0688975 | B1 | 3/2007 |
| KR | 10-1811146 | B1 | 12/2017 |

OTHER PUBLICATIONS

International Search Report dated Apr. 21, 2020, in corresponding International Application PCT /KR2019/017984.
European Search Report dated Nov. 30, 2021 issue in Application No. EP 19 900373.

* cited by examiner

REFRIGERATOR

CROSS-REFERENCE TO RELATED APPLICATION(S)

This application is based on and claims priority under 35 U.S.C. § 119 to Korean Patent Application No. 10-2018-0165592, filed on Dec. 19, 2018, in the Korean Intellectual Property Office, the disclosure of which is incorporated by reference herein in its entirety.

BACKGROUND

1. Field

The disclosure relates to a refrigerator, and more particularly to a refrigerator having an improved structure of a cool air supply system.

2. Description of Related Art

Generally, a refrigerator is an appliance that keeps food fresh by including a main body provided with a storage compartment therein and a cool air supply system for supplying cool air to the storage compartment. The storage compartment includes a refrigerating chamber that is maintained at temperature of about 0° C. to 5° C. to keep food refrigerated, and a freezing chamber that is maintained at temperature of about 0° C. to −30° C. to keep food frozen.

In the refrigerator, an insulating material is provided in a cabinet forming the storage compartment, and a machine room is positioned outside the cabinet. Among components constituting the cool air supply system, a compressor and a condenser are located in the machine room positioned outside the cabinet, an evaporator is located in the storage compartment positioned inside the cabinet, and a refrigerant pipe through which a refrigerant moves penetrates the insulating material.

Accordingly, when the cooling performance of the cool air supply system of the refrigerator is tested, the cooling performance test should be performed only after all components of the cool air supply system are installed in the cabinet. In addition, when the cool air supply system needs to be maintained and repaired, the cabinet should be disassembled.

SUMMARY

It is an aspect of the disclosure to provide a refrigerator capable of easily maintaining a cool air supply system.

It is another aspect of the disclosure to provide a refrigerator capable of preventing a loss of cool air.

Additional aspects of the disclosure will be set forth in part in the description which follows and, in part, will be obvious from the description, or may be learned by practice of the disclosure.

In accordance with an aspect of the disclosure, a refrigerator includes: a cabinet forming a storage chamber therein and including a cooling module mounting portion, a cabinet sealing portion formed on an outer surface of the cooling module mounting portion; a cooling module detachably mounted to the cooling module mounting portion and including an evaporator, a condenser, and a compressor, wherein the cooling module includes a module housing, and the module housing includes a module sealing portion facing the cabinet sealing portion, and at least a portion of the module sealing portion is positioned at an inclination with respect to a direction in which the cooling module is insertable into the cabinet to be mounted to the cabinet; and a sealing member positioned between the cabinet sealing portion and the module sealing portion.

The cabinet sealing portion may include a recessed groove, the module sealing portion may include a protrusion protruding so as to be inserted into the cabinet sealing portion when the cooling module is inserted into the cabinet to be mounted to the cabinet, and the sealing member may be inserted into the cabinet sealing portion and pressed by the module sealing portion when the cooling module is inserted into the cabinet to be mounted to the cabinet.

A size of the cabinet sealing portion may be larger than a size of the module sealing portion.

The module sealing portion may include a recessed groove, the cabinet sealing portion may include a protrusion protruding so as to be inserted into the module sealing portion when the cooling module is inserted into the cabinet to be mounted to the cabinet, and the sealing member may be inserted into the module sealing portion and pressed by the cabinet sealing portion when the cooling module is inserted into the cabinet to be mounted to the cabinet.

A size of the module sealing portion may be larger than a size of the cabinet sealing portion.

At least one portion of the cabinet sealing portion may be inclined to correspond to a module inclination portion of the module sealing portion.

The cabinet may include a duct opening communicating the cooling module with the storage chamber to receive cool air from the cooling module, and at least a portion of the sealing member may extend along an outer circumference of the duct opening.

The cabinet may include a module guide to guide a movement of the cooling module when the cooling module is inserted into the cabinet to be mounted to the cabinet, and the cooling module may include a mounting guide that is guided by the module guide and mounted to the module guide when the cooling module is inserted into the cabinet to be mounted to the cabinet.

The mounting guide may protrude from the module housing, and the module guide may include a groove to allow the mounting guide to be inserted.

The cooling module may further include a fixing member to fix the mounting guide to the module guide when the mounting guide is coupled to the module guide.

The module guide and the mounting guide may extend along the direction in which the cooling module is insertable into the cabinet to be mounted to the cabinet.

The refrigerator may further include silicon oil applied to the sealing member.

The module housing may include: a module body including an accommodating space in which the evaporator is mounted; and a module insulator provided in the module body such that the accommodating space is insulated from an outside.

The module housing may further include a base plate positioned below the module body and forming a machine room together with the module body, and the compressor and the condenser may be positioned in the machine room.

At least a portion of the module sealing portion may be positioned outside the accommodating space along a circumference of the accommodating space.

In accordance with another aspect of the disclosure, a refrigerator includes: a cabinet forming a storage chamber therein and including a cooling module mounting portion, a cabinet sealing portion formed on an outer surface of the cooling module mounting portion; a cooling module detachably mounted to the cooling module mounting portion and including a module housing in which an evaporator, a condenser, and a compressor are installed, wherein the module housing includes a module sealing portion interlocking with the cabinet sealing portion and having a size that is different from a size of the cabinet sealing portion; and a sealing member positioned in a gap formed between the cabinet sealing portion and the module sealing portion.

The cooling module may be insertable into the cabinet to be mounted to the cabinet, and the cabinet sealing portion or the module sealing portion may press the sealing member when the cooling module is inserted into the cabinet to be mounted to the cabinet.

At least a portion of the cabinet sealing portion and at least a portion of the module sealing portion may be inclined with respect to a direction in which the cooling module is insertable into the cabinet to be mounted to the cabinet.

The cooling module may include a mounting guide extending along a direction in which the cooling module is insertable into the cabinet to be mounted to the cabinet and formed on one surface facing the cabinet, and the cabinet may include a module guide coupled to the mounting guide.

The refrigerator may further include silicon oil applied to the cabinet sealing portion or the module sealing portion.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
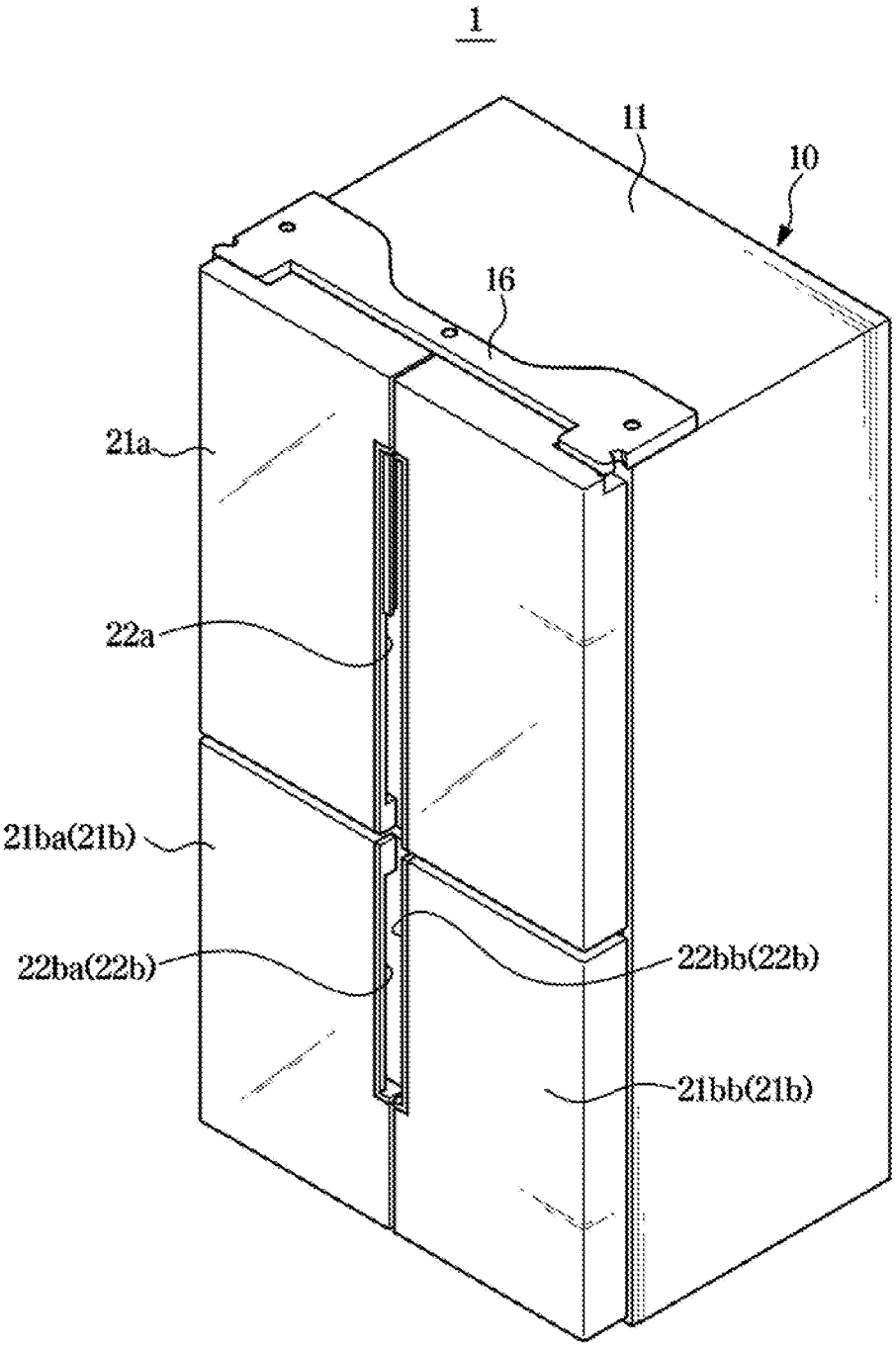
FIG. 1 is a perspective view of a refrigerator according to an embodiment of the disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present invention is provided for illustration purpose only and not for the purpose of limiting or/or restricting the invention. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that although the terms first, second, etc. may be used herein to describe various components, these components should not be limited by these terms, and the terms are only used to distinguish one component from another. For example, without departing from the scope of the present invention, the first component may be referred to as a second component, and similarly, the second component may also be referred to as a first component. The term "and/or" includes any combination of a plurality of related items or any one of a plurality of related items. As used herein, the term "and/or" includes any and all combinations of one or more of associated listed items.

Meanwhile, in the following description, the terms "front direction", "rear direction", "upper portion", "lower portion", etc. are defined based on the drawings, and the shapes and positions of the components are not limited by the terms.

Hereinafter, embodiments of the disclosure will be described in detail with reference to the accompanying drawings.

Figure 2:
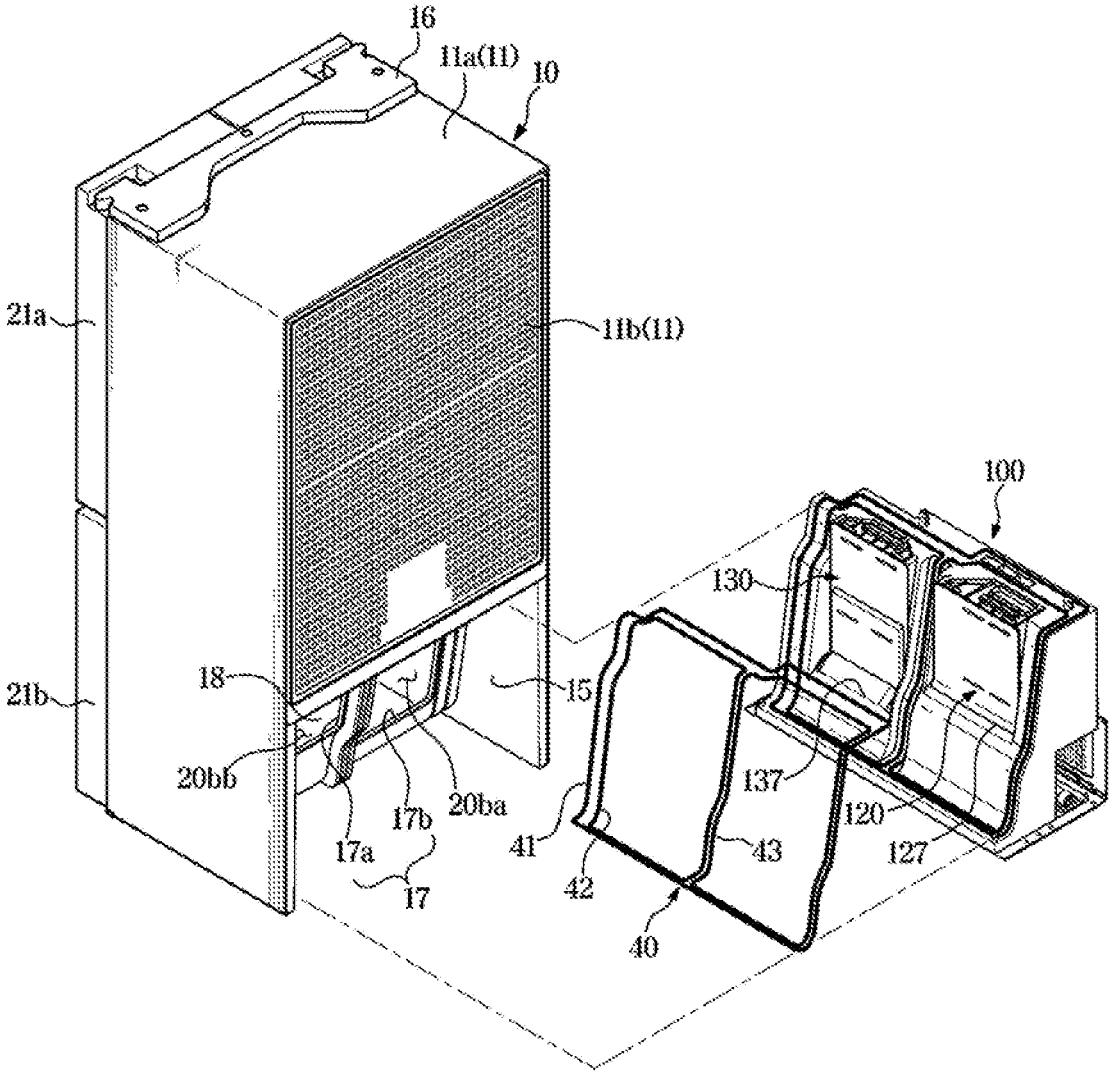
FIG. 2 shows a state in which a cooling module is separated from a cabinet of the refrigerator illustrated in FIG. 1.
Figure 3:
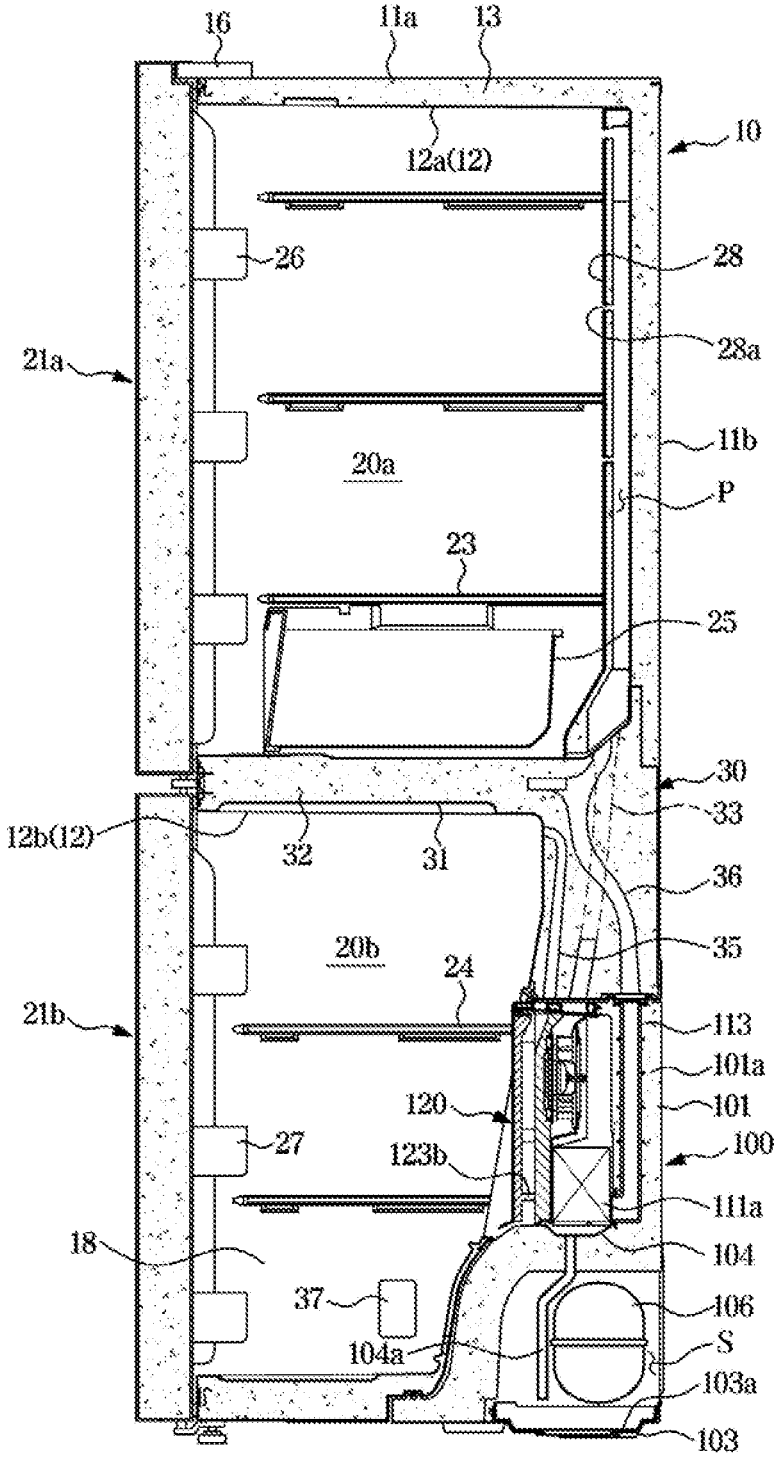
FIG. 3 is a cross-sectional view of the refrigerator illustrated in FIG. 1.

FIG. 1 is a perspective view of a refrigerator according to an embodiment of the disclosure, FIG. 2 shows a state in which a cooling module is separated from a cabinet of the refrigerator illustrated in FIG. 1, and FIG. 3 is a cross-sectional view of the refrigerator illustrated in FIG. 1.

Referring to FIGS. 1 to 3, a refrigerator 1 may include a cabinet 10 forming a plurality of storage chambers 20*a* and 20*b*, a plurality of doors 21*a* and 21*b* configured to open and close the storage chambers 20*a* and 20*b*, and a cooling module 100 detachably coupled to the cabinet 10 and configured to supply cool air to the storage chambers 20*a* and 20*b*.

The cabinet 10 may include an outer case 11, and an inner case 12 coupled to an inner side of the outer case 11. The outer case 11 may include a cabinet body 11*a*, wherein front and rear sides of the cabinet body 11*a* open, and a cabinet cover 11*b* covering the rear side of the cabinet body 11*a*. The front side of the cabinet body 11*a* may be covered by the doors 21*a* and 21*b*. The outer case 11 may be made of a metal material.

The inner case 12 may form the storage chambers 20*a* and 20*b*. The inner case 12 may be formed by injection-molding a plastic material. The inner case 12 may include a first inner case 12*a* forming the upper storage chamber 20*a*, and a second inner case 12*b* forming the lower storage chamber 20*b*.

A cabinet insulator 13 may be provided between the outer case 11 and the inner case 12. The cabinet insulator 13 may be urethane foam insulation, and may be used together with a vacuum insulation panel, as necessary.

The cabinet 10 may include a middle body 30 positioned between the first inner case 12*a* and the second inner case 12*b*. The middle body 30 may include a partition 31 for partitioning the storage chambers 20*a* and 20*b* into the upper chamber 20*a* and the lower chamber 20*b*. The middle body 30 may include a middle body insulator 32 therein to prevent heat exchange between the upper storage chamber 20*a* and the lower storage chamber 20*b*. The middle body insulator 32 may prevent a loss of cool air from a portion of a rear side of the lower storage chamber 20*b* to an outside.

In the middle body 30, a first cool air duct 33, a second cool air duct (not shown), a third cool air duct 35, and a first circulation duct 36 may be positioned. The first cool air duct 33, the second cool air duct, the third cool air duct 35, and the first circulation duct 36 may penetrate the middle body insulator 32.

The first cool air duct 33 may guide cool air generated by the cooling module 100 to the first storage chamber 20*a*. The second cool air duct may guide cool air generated by the cooling module 100 to a second storage chamber 20*ba*. The third cool air duct 35 may guide cool air generated by the cooling module 100 to a third storage chamber 20*bb*. The first circulation duct 36 may guide air that has cooled the first storage chamber 20*a* to the cooling module 100.

Front sides of the storage chambers 20*a* and 20*b* may open to store or take out food. The storage chambers 20*a* and 20*b* may include the upper storage chamber 20*a* and the lower storage chamber 20*b*. The upper storage chamber 20*a* may be used as a refrigerating chamber that is maintained at about 0° C. to 5° C. to keep food refrigerated. The upper storage chamber 20*a* is also referred to as the first storage chamber 20*a*.

Referring to FIG. 3, in the first storage chamber 20*a*, a guide cover 28 may be positioned to distribute cool air supplied from the first cool air duct 33. The guide cover 28 may form a passage P through which cool air transferred from the first cool air duct 33 flows, together with the first inner case 12*a*.

The guide cover 28 may include a guide hole 28*a* for supplying cool air transferred from the first cool air duct 3 to the first storage chamber 20*a*. A plurality of guide holes 28*a* may be arranged along up down directions.

The lower storage chamber 20*b* may include the second storage chamber 20*ba* and the third storage chamber 20*bb*. The cabinet 10 may include a separation plate 18 for partitioning the second storage chamber 20*ba* and the third storage chamber 20*bb*. The second storage chamber 20*ba* may be used as a freezing chamber that is maintained at about −30° C. to 0° C. to store food frozen. The third storage chamber 20*bb* may be used as a temperature changing chamber where temperature changes. However, the use of the first storage chamber 20*a*, the second storage chamber 20*ba*, and the third storage chamber 20*bb* may change.

The open front sides of the storage chambers 20*a* and 20*b* may be opened and closed by the doors 21*a* and 21*b*. In the storage chambers 20*a* and 20*b*, a plurality of shelves 23 and 24 on which food may be placed, and a storage container 25 in which food may be stored may be provided.

The upper door 21*a* may open and close the first storage chamber 20*a*. The upper door 21*a* may be coupled to the cabinet 10 to be rotatable in left and right directions. An upper door guard 26 for storing food may be provided on a rear surface of the upper door 21*a*. A hinge cover 16 may be provided at a portion of the cabinet 10 to which the upper door 21*a* is coupled. The upper door 21*a* is also referred to as the first door 21*a*.

The first door 21*a* may include a first door handle 22*a*. A user may grip the first door handle 22*a* to open and close the first door 21*a*.

The lower door 21*b* may open and close the lower storage chamber 20*b*. The lower door 21*b* may be coupled to the cabinet 10 to be rotatable in the left and right directions. A lower door guard 27 for storing food may be provided on a rear surface of the lower door 21*b*. The lower door 21*b* may include a second door 21*ba* for opening and closing the second storage chamber 20*ba*, and a third door 21*bb* for opening and closing the third storage chamber 20*bb*.

The lower door 21*b* may include a lower door handle 22*b*. The user may grip the lower door handle 22*b* to open and close the lower door 21*b*. Specifically, the second door 21*ba* may include a second door handle 22*ba*, and the third door 21*bb* may include a third door handle 22*bb*.

A lower portion of the cabinet 10 may be provided with a cooling module mounting portion 15 to which the cooling module 100 is detachably mounted. The cooling module mounting portion 15 may be provided with a size and shape corresponding to the cooling module 100.

The cabinet 10 may include a duct opening 17. The duct opening 17 may be formed in the cooling module mounting portion 15. The duct opening 17 may be formed in a portion of the cabinet 10 facing the cooling module 100. The duct opening 17 may include a second duct opening 17*b* for communicating the second storage chamber 20*ba* with the cooling module mounting portion 15, and a first duct opening 17*a* for communicating the third storage chamber 20*bb* with the cooling module mounting portion 15. The duct opening 17 may penetrate the cabinet 10.

The refrigerator 1 may include a sealing member 40 for sealing between the cabinet 10 and the cooling module 100. The sealing member 40 may be positioned in the cooling module mounting portion 15. The sealing member 40 may be positioned on an area where the cooling module 100 is coupled to the cabinet 10. A portion of the sealing member 40 may be positioned outside the duct opening 17 along a circumference of the duct opening 17. A portion of the sealing member 40 may be positioned outside the accommodating spaces 101*b* and 101*c* along circumferences of the accommodating spaces 101*b* and 101*c*. A plurality of sealing members 40 may be provided.

Figure 4:
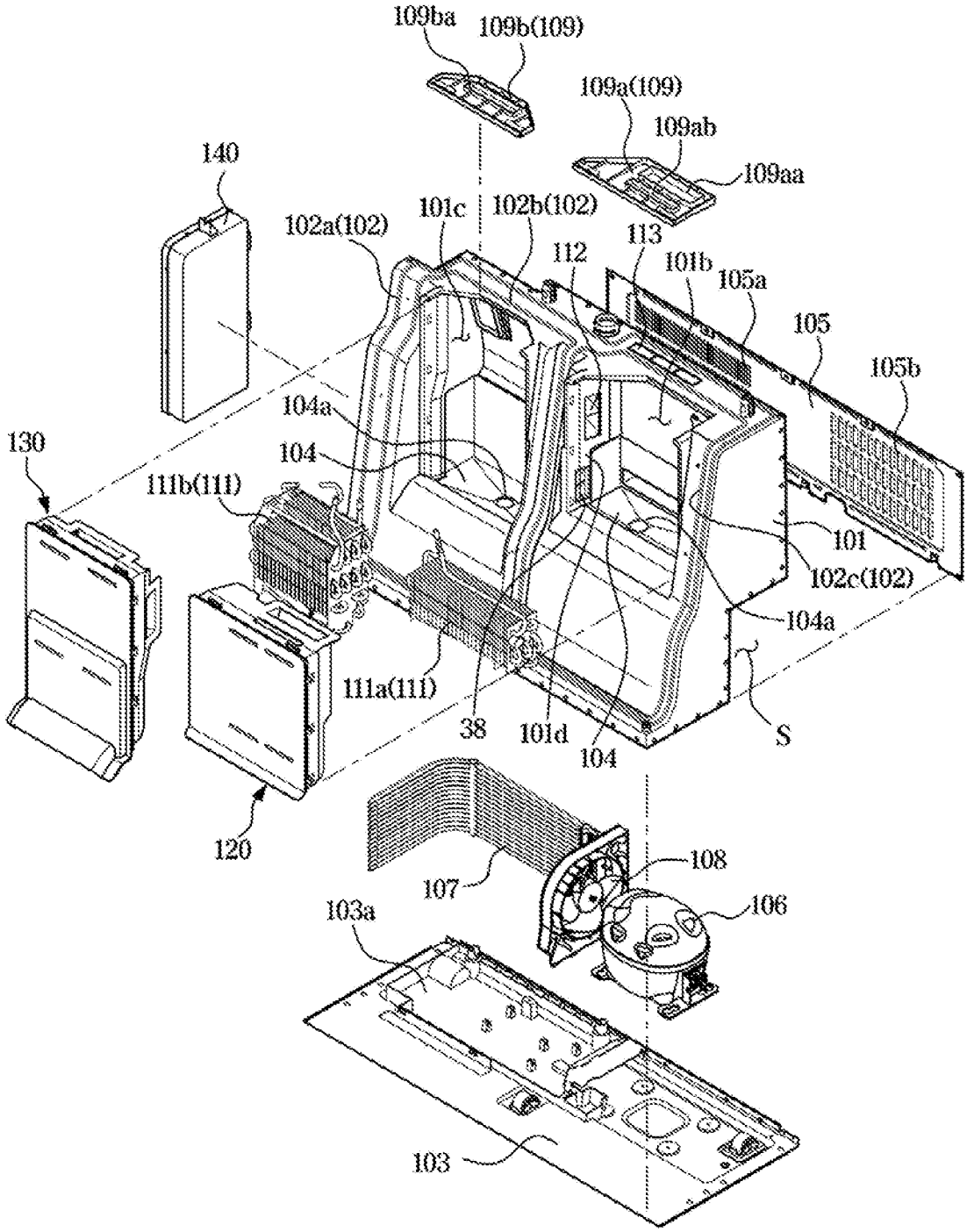
FIG. 4 is an exploded perspective view of the cooling module illustrated in FIG. 2.
Figure 5:
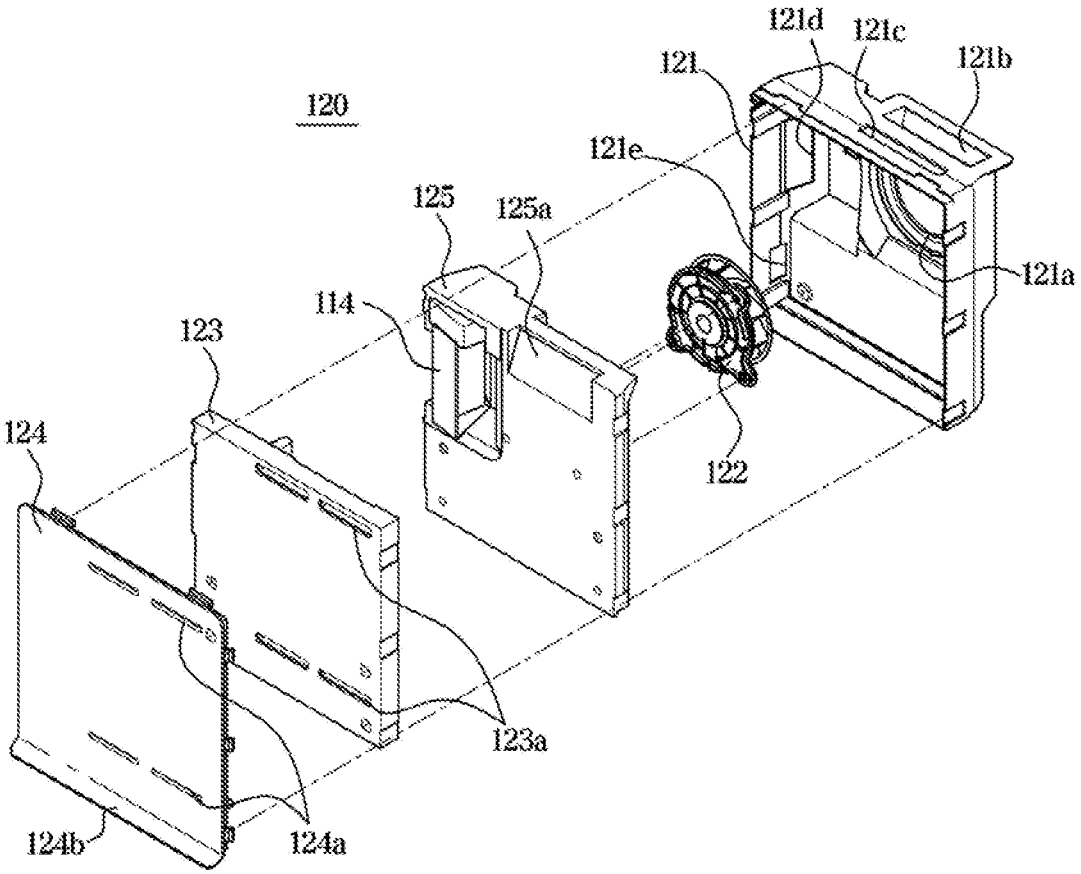
FIG. 5 is an exploded perspective view of a first duct module illustrated in FIG. 4.
Figure 6:
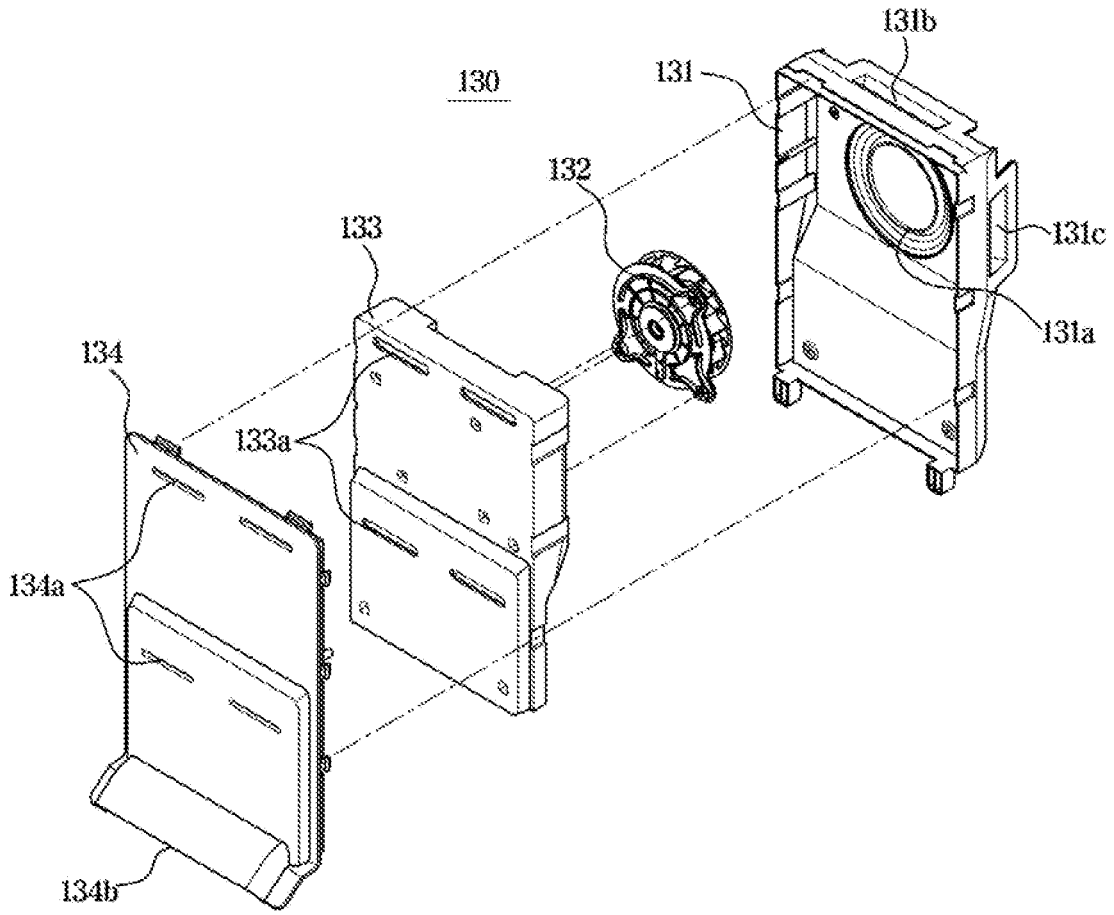
FIG. 6 is an exploded perspective view of a second duct module illustrated in FIG. 4.

FIG. 4 is an exploded perspective view of the cooling module illustrated in FIG. 2, FIG. 5 is an exploded perspective view of a first duct module illustrated in FIG. 4, and FIG. 6 is an exploded perspective view of a second duct module illustrated in FIG. 4.

The cooling module 100 may generate cool air by using evaporative latent heat of a refrigerant through a cooling cycle. The cooling module 100 may generate cool air to be supplied to the first storage chamber 20*a*, the second storage chamber 20*ba*, and the third storage chamber 20*bb*. The cooling module 100 may be detachably mounted to the cabinet 10 from the outside.

Referring to FIG. 4, the cooling module 100 may include a module body 101, a base plate 103, a compressor 106, a condenser 107, an evaporator 111, and an expansion valve (not shown).

The module body 101 may form a portion of a rear surface of the refrigerator 1. The module body 101 may include a module insulator 101*a* provided therein to prevent a loss of cool air generated from the evaporator 111.

The module body 101 may include the accommodating spaces 101*b* and 101*c* in which the evaporator 111 is positioned. Specifically, the accommodating spaces 101*b* and 101*c* may include the first accommodating space 101*b* in which a first evaporator 111*a* is positioned, and the second accommodating space 101*c* in which a second evaporator 111*b* is positioned.

The module body 101 may include a separation wall 101*d* positioned between the first accommodating space 101*b* and the second accommodating space 101*c*. The separation wall 101*d* may correspond to a boundary between the second storage chamber 20*ba* and the third storage chamber 20*bb*. The module insulator 101*a* may also be positioned in an inside of the separation wall 101*d*.

In the separation wall 101*d*, a connection duct 112 may penetrate the module insulator 101*a*. The connection duct 112 may move cool air to be supplied to the third storage chamber 20*bb*. The connection duct 112 may communicate the first accommodating space 101*b* with the second accommodating space 101*c*. One end of the connection duct 112 may be connected to a first fan connection opening 121*d*, and the other end of the connection duct 112 may be connected to a second fan connection opening 131*c*.

In the separation wall 101*d*, a third circulation duct 38 may penetrate the module insulator 101*a*. The third circulation duct 38 may move air that has cooled the third storage chamber 20*bb* to the second evaporator 111*b*. The third circulation duct 38 may communicate the first accommodating space 101*b* with the second accommodating space 101*c*. The third circulation duct 38 may communicate a part of a space between a separation cover 125 and a first fan cover 123 with a space where the second evaporator 111*b* is positioned.

The module body 101 may be provided with a guide duct 113. The guide duct 113 may penetrate the module insulator 101*a* of the module body 101. The guide duct 113 may be connected to the first circulation duct 36. The guide duct 113 may communicate the first circulation duct 36 with the first accommodating space 101*b* where the first evaporator 111*a* is positioned.

The base plate 103 may be positioned below the module body 101. The base plate 103 may cover a bottom of the module body 101. The compressor 106 may be fixed to the base plate 103. The condenser 107 may be fixed to the base plate 103. A cooling fan 108 may be fixed to the base plate 103.

On the base plate 103, a collecting pan 103*a* may be positioned. The collecting pan 103*a* may collect condensate water generated by the condenser 107 and/or the evaporator 111. The condenser 107 may be positioned above the collecting pan 103*a*.

The module body 101 may include a plurality of drain pipes 104*a* and a plurality of drain pans 104 for guiding condensate water generated by the evaporator 111 to the collecting pan 103*a*. One of the drain pans 104 may be positioned below the evaporator 111. The drain pans 104 may be positioned below the first evaporator 111*a* and below the second evaporator 111*b*, respectively. The drain pans 104 may be positioned in the first accommodating space 101*b* and the second accommodating space 101*c*, respectively.

The drain pipes 104*a* may guide condensate water collected in the drain pans 104 to the collecting pan 103*a*. At least a portion of the drain pipes 104*a* may penetrate the module insulator 101*a*.

On the base plate 103, an electronic equipment box 140 may be positioned. The electronic equipment box 140 may be positioned on one side where the second accommodating space 101*c* is positioned. The electronic equipment box 140 may control the cooling module 100 to change temperature of the storage chambers 20*a* and 20*b*. The electronic device box 140 may be supplied power for driving the refrigerator 1.

The module cover 105 may cover a rear lower portion of the module body 101. The module cover 105 may cover a machine room S which is provided in the lower portion of the module body 101 and in which the compressor 106, the condenser 107, and the cooling fan 108 are positioned, together with the base plate 103. The module cover 105 may include a cover inlet 105*a* through which outside air is introduced by the cooling fan 108, and a cover outlet 105*b* through which introduced air is discharged to the outside.

The compressor 106 may compress a refrigerant and move the refrigerant to the condenser 107. The condenser 107 may condense the refrigerant and move the refrigerant to the expansion valve. The cooling fan 108 may cool the compressor 106 and the condenser 107. When the cooling fan 108 is driven, air may be introduced into the machine room S through the cover inlet 105*a* and heat-exchanged with the condenser 107 and the compressor 106, and then discharged to the outside of the machine room S through the cover outlet 105*b*.

The module body 101, the base plate 103, and the module cover 105 described above are collectively referred to as a module housing.

The evaporator 111 may generate cool air. The evaporator 111 may be positioned in the accommodating spaces 101*b* and 101*c*. The evaporator 111 may include the first evaporator 111*a* and the second evaporator 111*b*. The first evaporator 111*a* may be positioned in the first accommodating space 101*b*. The second evaporator 111*b* may be positioned in the second accommodating space 101*c*.

The cooling module 100 may include a cap 109 covering an open upper area of the accommodating spaces 101*b* and 101*c*. The cap 109 may include a first cap 109*a* for covering a upper area of the first accommodating space 101*b*, and a second cap 109*b* for covering a upper area of the second accommodating space 101*c*.

The first cap 109*a* may be positioned above a first duct module 120. The first cap 109*a* may include a 1a-th cap hole 109*aa* positioned to correspond to a first-a fan outlet 121*b* formed in a first fan case 121, and a 1b-th cap hole 109*ab* positioned to correspond to a 1b-th fan outlet 121*c* formed in the first fan case 121. The 1a-th cap hole 109*aa* may communicate with the first cool air duct 33. The 1b-th cap hole 109*ab* may communicate with the third cool air duct 35.

The second cap 109*b* may be positioned above a second duct module 130. The second cap 109*b* may include a second cap hole 109*ba* positioned to correspond to a second fan outlet 131*b* formed in a second fan case 131. The second cap hole 109*ba* may communicate with the second cool air duct.

In the accommodating spaces 101*b* and 101*c*, the duct modules 120 and 130 for moving cool air generated by the evaporator 111 to the storage chambers 20*a* and 20*b* may be positioned. The duct modules 120 and 130 may include the first duct module 120 positioned in the first accommodating space 101*b* and the second duct module 130 positioned in the second accommodating space 101*c*.

Specifically, referring to FIGS. 5 and 6, the first duct module 120 may include the first fan case 121, a first fan 122, the first fan cover 123, a first duct cover 124, and the separation cover 125.

The first fan case 121 may cover the first fan 122. The first fan case 121 may be detachably coupled to the first accommodating space 101*b*. The first fan case 121 may be fixed to the module body 101.

The first fan case 121 may include a first fan inlet 121*a* through which air heat-exchanged with the first evaporator 111*a* is introduced. The first fan inlet 121*a* may be formed in a rear side of the first fan case 121.

The first fan case 121 may include the 1a-th fan outlet 121*b* communicating with the first cool air duct 33. The 1a-th fan outlet 121*b* may discharge cool air to be supplied to the first storage chamber 20*a*. The 1a-th fan outlet 121*b* may be formed in a top side of the first fan case 121.

The first fan case 121 may include the 1b-th fan outlet 121*c* communicating with the third cool air duct 35. The 1b-th fan outlet 121*c* may discharge cool air to be supplied to the third storage chamber 20*bb*. The 1b-th fan outlet 121*c* may be formed in the top side of the first fan case 121.

The first fan case 121 may include the first fan connection opening 121*d* communicating with the connection duct 112. The first fan connection opening 121*d* may receive air blown by a second fan 132. The first fan connection opening 121*d* may receive cool air to be supplied to the third storage chamber 20*bb*. The first fan connection port 121*d* may be formed in a lateral side of the first fan case 121.

The first fan case 121 may include a first fan circulation opening 121*e* communicating with the third circulation duct 38. The first fan circulation opening 121*e* may guide air that has cooled the third storage chamber 20*bb* to the second evaporator 111*b*. The first fan circulation opening 121*e* may discharge air introduced into the first duct module 120 through a first duct circulation opening 127 to the second accommodating space 101*c* in which the second evaporator 111*b* is positioned. The first fan circulation opening 121*e* may be formed in a side of the first fan case 121 facing the separation wall 101*d*.

The first fan 122 may be driven to supply air heat-exchanged with the first evaporator 111*a* to the first storage chamber 20*a*. The first fan 122 may be positioned in the first accommodating space 101*b*. The first fan 122 may be fixed to the separation cover 125.

The first fan cover 123 may be coupled to a front side of the first fan case 121. The separation cover 125 may be positioned between the first fan cover 123 and the first fan case 121.

Referring to FIG. 3, a separation rib 123*b* may be provided on a rear surface of the first fan cover 123 to partition a space between the separation cover 125 and the first fan cover 123. By the separation rib 123*b*, the space between the first fan cover 123 and the separation cover 125 may be partitioned into a space to which air is supplied from the connection duct 112 and a space to which air that has cooled the third storage chamber 20*bb* returns.

The separation cover 125 may cover the front side of the first fan case 121. The separation cover 125 may separate an inside space defined by the first fan case 121 and the first fan cover 123. The separation cover 125 may form a space through which cool air to be supplied to the first storage chamber 20*a* moves, together with the first fan case 121. The separation cover 125 may form a space through which cool air to be supplied to the third storage chamber 20*bb* moves, together with the first fan cover 123. Behind the separation cover 125, a passage through which air heat-exchanged with the first evaporator 111*a* moves may be formed, and in front of the separation cover 125, a passage through which air heat-exchanged with the second evaporator 111*b* moves may be formed. Also, behind the separation cover 125, a passage through which air moving by the first fan 122 flows may be formed, and in front of the separation cover 125, a passage through which air moving by the second fan 132 flows may be formed.

The separation cover 125 may prevent air heat-exchanged with the first evaporator 111*a* from being mixed with air heat-exchanged with the second evaporator 111*b*. The separation cover 125 may prevent air moving by the first fan 122 from being mixed with air moving by the second fan 132. The separation cover 125 may support the first fan 122.

The separation cover 125 may include a hole forming portion 125*a* that forms a hole communicating with the third cool air duct 35 when the separation cover 125 is coupled to the first fan cover 123. The hole forming portion 125*a* may be formed in an upper portion of the separation cover 125.

The separation cover 125 may be provided with a connection duct damper 114 for adjusting an amount of cool air passing through the connection duct 112. Temperature of the third storage chamber 20*bb* may be adjusted according to a degree of opening of the connection duct damper 114.

The first fan cover 123 may be positioned in front of the separation cover 125. The first fan cover 123 may form a space through which cool air to be supplied to the third storage chamber 20*bb* flows, together with the separation cover 125. The first fan cover 123 may be detachably coupled to the first fan case 121.

The first fan cover 123 may include a first cover hole 123*a* communicating with the third storage chamber 20*bb*. The first cover hole 123*a* may discharge a part of air introduced through the connection duct 112 to the third storage chamber 20*bb*. A part of cool air introduced through the connection duct 112 may be transferred to the third cool air duct 35 and then supplied to the third storage chamber 20*bb*, and the other part of the cool air may be supplied to the third storage chamber 20*bb* through the first cover hole 123*a*.

The first duct cover 124 may be positioned in front of the first fan cover 123. The first duct cover 124 may cover a front side of the first fan cover 123. The first duct cover 124 may include a first duct hole 124*a* communicating with the third storage chamber 20*bb*. The first duct hole 124*a* may be positioned to correspond to the first cover hole 123*a*. A part of cool air blown by the second fan 132 may be supplied to the third storage chamber 20*bb* through the first cover hole 123*a* and the first duct hole 124*a*.

The first duct cover 124 may include a first duct inlet 124*b*. The first duct inlet 124*b* may be spaced a predetermined distance from the module body 101. The first duct inlet 124 may form the first duct circulation opening 127 together with the module body 101. Air that has cooled the third storage chamber 20*bb* through the first duct circulation opening 127 may return to the first duct module 120. The air returned through the first duct circulation opening 127 may be guided to the second evaporator 111*b* through the third circulation duct 38.

The second duct module 130 may include the second fan case 131, the second fan 132, a second fan cover 133, and a second duct cover 134.

The second fan case 131 may be positioned in the second accommodating space 101*c*. The second fan case 131 may include a second fan inlet 131*a* through which air heat-exchanged with the second evaporator 111*b* is introduced. The second fan inlet 131*a* may be formed in a rear side of the second fan case 131.

The second fan case 131 may include the second fan outlet 131*b* communicating with the second cool air duct 34. The second fan outlet 131*b* may discharge cool air to be supplied to the second storage chamber 20*ba*. The second fan outlet 131*b* may be formed in a top side of the second fan case 131.

The second fan case 131 may include the second fan connection opening 131*c* communicating with the connection duct 112. The second fan connection opening 131*c* may discharge air blown by the second fan 132 to the connection duct 112. The second fan connection opening 131*c* may discharge cool air to be supplied to the third storage chamber 20*bb*. The second fan connection opening 131*c* may be formed in a lateral side of the second fan case 131.

The second fan 132 may be driven to supply air heat-exchanged with the second evaporator 111*b* to the second storage chamber 20*ba* and the third storage chamber 20*bb*. The second fan 132 may be positioned in the second accommodating space 101*c*. The second fan 132 may be fixed to the second fan cover 133.

The second fan cover 133 may be coupled to the front side of the second fan case 131. The second fan cover 133 may cover the front side of the second fan case 131. The second fan cover 133 may form a space through which cool air to be supplied to the second storage chamber 20*ba* and the third storage chamber 20*bb* flows, together with the second fan case 131. The second fan cover 133 may be fixed to the second fan case 131.

The second fan cover 133 may include a second cover hole 133*a* communicating with the second storage chamber 20*ba*. The second cover hole 133*a* may discharge a part of air drawn by the second fan 132 to the second storage chamber 20*ba*. A part of air drawn by the second fan 132 may be transferred to the second cool air duct and then supplied to the second storage chamber 20*ba*, and the other part of the air may be supplied to the second storage chamber 20*ba* through the second cover hole 133*a*. The second fan cover 133 may support the second fan 132.

The second duct cover 134 may be positioned in front of the second fan cover 133. The second duct cover 134 may cover a front side of the second fan cover 133.

The second duct cover 134 may include a second duct hole 134*a* communicating with the second storage chamber 20*ba*. The second duct hole 134*a* may correspond to the second cover hole 133*a*. A part of cool air blown by the second fan 132 may be supplied to the second storage chamber 20*ba* through the second cover hole 133*a* and the second duct hole 134*a*.

The second duct cover 134 may include a second duct inlet 134*b*. The second duct inlet 134*b* may be spaced a predetermined distance from the module body 101. The second duct inlet 134*b* may form the second duct circulation opening 137 together with the module body 101. Air that has cooled the second storage chamber 20*ba* through the second duct circulation opening 137 may return to the second duct module 130. Air returned through the second duct circulation opening 137 may be guided to the second evaporator 111*b*.

The separation plate 18 may include the second circulation duct 37. The second circulation duct 37 may penetrate the separation plate 18. The second circulation duct 37 may communicate the second storage chamber 20*ba* with the third storage chamber 20*bb*. A part of air that has cooled the third storage chamber 20*ba* may move to the second storage chamber 20*ba* through the second circulation duct 37. The air that has moved to the second storage chamber 20*ba* may return to the cooling module 100 together with the air that has cooled the second storage chamber 20*ba*.

According to this configuration, in the refrigerator 1 according to an embodiment of the disclosure, all components of the cool air supply system may be arranged in the cooling module 100, and the cooling module 100 may be detachably mounted to the cabinet 10, so that cooling performance of the cool air supply system may be tested before the cooling module 100 is mounted to the cabinet 10. In addition, when the cool air supply system is separated from the cabinet 10 to be maintained and repaired, maintenance of the refrigerator 1 may be easy.

Figure 7:
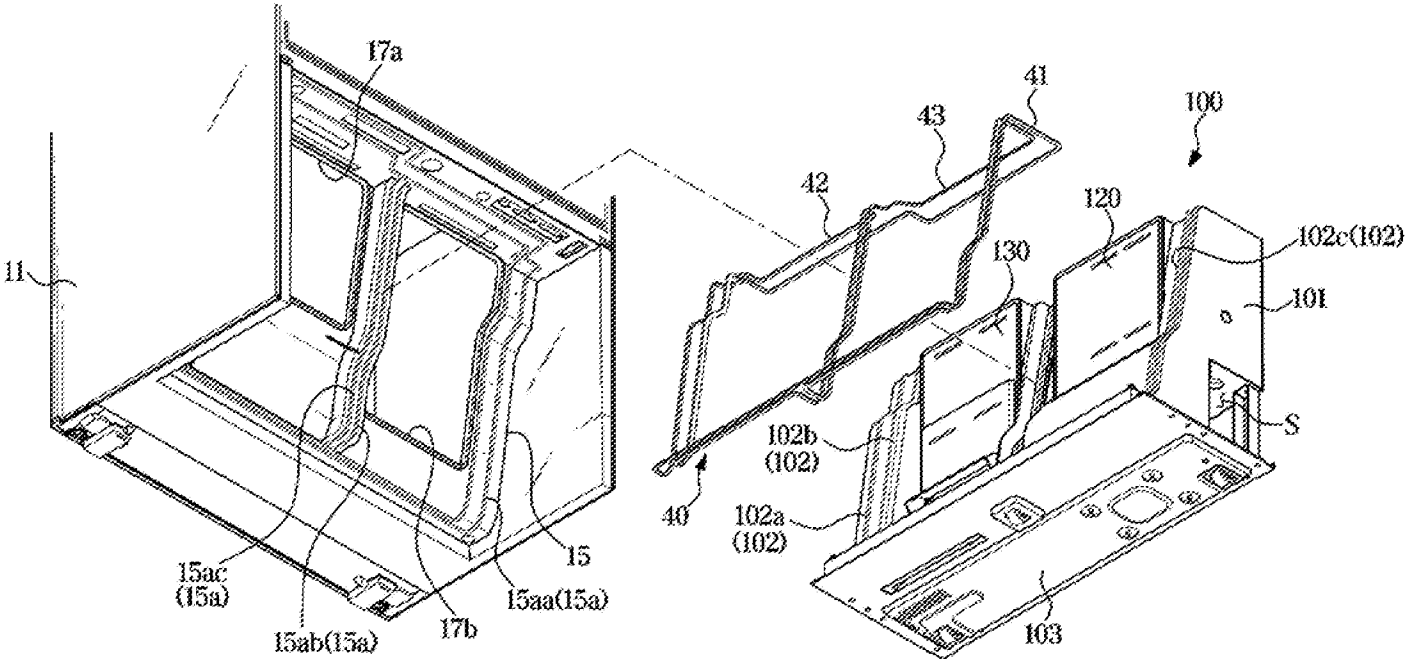
FIG. 7 is a bottom perspective view illustrating a coupling relationship between a cabinet, the cooling module, and a sealing member illustrated in FIG. 2.
Figure 8:
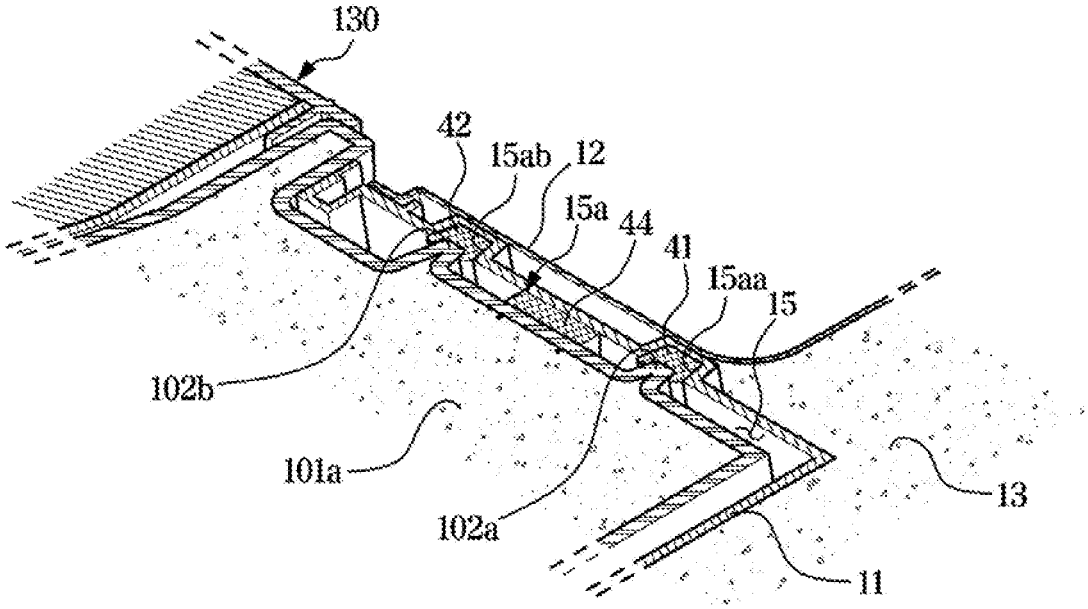
FIG. 8 is a partially cross-sectional view illustrating a state in which the cabinet, the cooling module, and the sealing member illustrated in FIG. 7 are coupled to each other.
Figure 9:
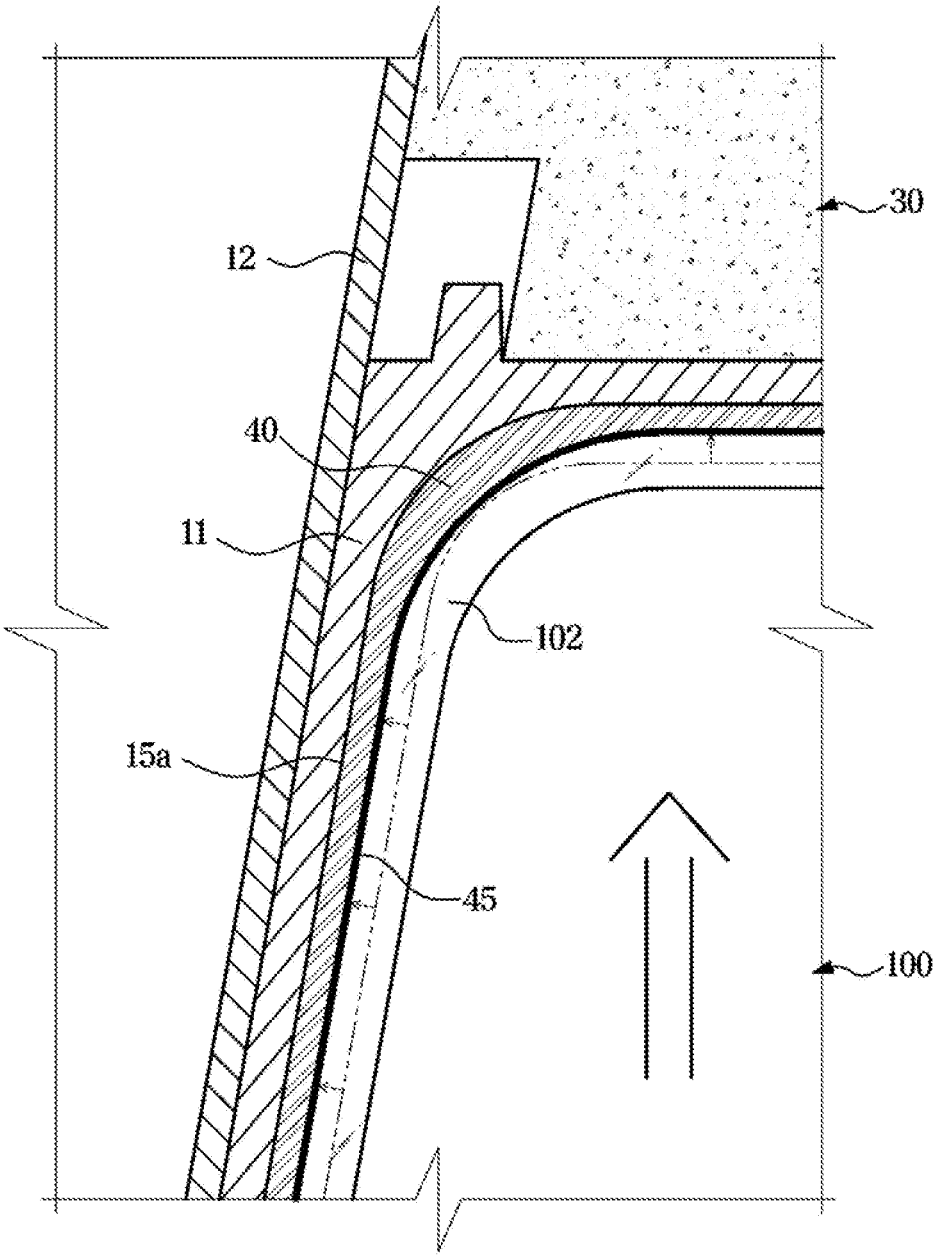
FIG. 9 shows a state in which the sealing member is pressed when the cooling module illustrated in FIG. 7 is mounted to the cabinet.

FIG. 7 is a bottom perspective view illustrating a coupling relationship between the cabinet, the cooling module, and the sealing member illustrated in FIG. 2, FIG. 8 is a partially cross-sectional view illustrating a state in which the cabinet, the cooling module, and the sealing member illustrated in FIG. 7 are coupled to each other, and FIG. 9 shows a state in which the sealing member is pressed when the cooling module illustrated in FIG. 7 is mounted to the cabinet.

Referring to FIGS. 7 and 8, a cabinet sealing portion 15*a* may be formed in the cooling module mounting portion 15 of the cabinet 10. The cabinet sealing portion 15*a* may be formed on a surface of the cabinet 10 facing the cooling module 100. The cabinet sealing portion 15*a* may be formed on at least one of an inner upper surface, an inner front surface, and an inner lower surface of the cooling module mounting portion 15. The cabinet sealing portion 15*a* may extend along an outer circumference of the duct opening 17.

The cabinet sealing portion 15*a* may include a third cabinet sealing portion 15*ac*, at least a portion of which extends along an outer circumference of the first duct opening 17*a*, a second cabinet sealing portion 15*ab*, at least a portion of which extends along an outer circumference of the second duct opening 17*b*, and a first cabinet sealing portion 15*aa* extending along the outer circumferences of the second cabinet sealing portion 15*ab* and the third cabinet sealing portion 15*ac*.

A module sealing portion 102 may be formed on the module body 101 of the module housing of the cooling module 100. The module sealing portion 102 may be formed on a surface of the module body 101 facing the cabinet 10. The module sealing portion 102 may be formed on at least one of an upper surface, a front surface, and a bottom surface of the module body 101. The module sealing portion 102 may face the cabinet sealing portion 15*a*. The module sealing portion 102 may extend along outer circumferences of the accommodating spaces 101*b* and 101*c*. The module sealing portion 102 may have a size that is different from that of the cabinet sealing portion 15*a*.

The module sealing portion 102 may include a third module sealing portion 102*c*, at least a portion of which extends along an outer circumference of the first accommodating space 101*b*, a second module sealing portion 102*b*, at least a portion of which extends along an outer circumference of the second accommodating space 101*c*, and a first module sealing portion 102*a* extending along the outer circumferences of the second module sealing portion 102*b* and the third module sealing portion 102*c*.

The sealing member 40 may be positioned between the cabinet sealing portion 15*a* and the module sealing portion 102. The sealing member 40 may include a first sealing member 41 positioned between the first cabinet sealing portion 15*aa* and the first module sealing portion 102*a*, a second sealing member 42 positioned between a second cabinet sealing portion 15*b* and the second module sealing portion 102*b*, and a third sealing member 43 positioned between a third cabinet sealing portion 15*c* and the third module sealing portion 102*c*.

Specifically, referring to FIG. 8, the cabinet sealing portion 15*a* may include a portion formed as a recessed groove, and the module sealing portion 102 may include a portion formed as a protrusion protruding to be inserted into the cabinet sealing portion 15*a*. In this case, the sealing member 40 may be inserted into the groove of the cabinet sealing portion 15*a* and pressed by the protrusion of the module sealing portion 102.

Specifically, the first sealing member 41 may be positioned in the first cabinet sealing portion 15*aa*, and may be pressed by the first module sealing portion 102*a*. The second sealing member 42 may be inserted in the second cabinet sealing portion 15*ab* and pressed by the second module sealing portion 102*b*.

The groove of the cabinet sealing portion 15*a* may have a size that is larger than that of the protrusion of the module sealing portion 102. Accordingly, a gap may be made between the cabinet sealing portion 15*a* and the module sealing portion 102. The sealing member 40 may be positioned in the gap.

In addition, the module sealing portion 102 may include a portion formed as a recessed groove, and the cabinet sealing portion 15*a* may include a portion formed as a protrusion protruding to be inserted into the module sealing portion 102. The groove of the module sealing portion 102 may be positioned between protrusions of the module sealing portion 102, and the protrusion of the cabinet sealing portion 15*a* may be positioned between grooves of the cabinet sealing portion 15*a*.

In this case, the sealing member 40 may be inserted into the groove of the module sealing portion and pressed by the protrusion of the cabinet sealing portion 15*a*. Specifically, although not shown in FIG. 2, the sealing member 40 may include a fourth sealing member 44. The fourth sealing member 44 may be positioned in the groove of the module sealing portion 102, and may be pressed by the cabinet sealing portion 15*a*.

The groove of the module sealing portion 102 may have a size that is larger than that of the protrusion of the cabinet sealing portion 15*a*. Accordingly, a gap may be made between the module sealing portion 102 and the cabinet sealing portion 15*a*.

The sealing member 40 may be positioned in the gap.

In FIG. 8, the first cabinet sealing portion 15*aa*, the first module sealing portion 102*a*, the first sealing member 41, the second cabinet sealing portion 15*ab*, the second module sealing portion 102*b*, and the second sealing member 42 are shown. However, the third cabinet sealing portion 15*ac*, the third module sealing portion 102*c*, and the third sealing member 43 may also be provided with the same configuration as the first cabinet sealing portion 15*aa*, the first module sealing portion 102*a*, the first sealing member 41, the second cabinet sealing portion 15*ab*, the second module sealing portion 102*b*, and the second sealing member 42, respectively.

Referring to FIGS. 8 and 9, the sealing member 40 may be pressed between the cabinet sealing portion 15*a* and the module sealing portion 102 to tightly seal a gap between the cabinet 10 and the cooling module 100. The sealing member 40 may be pressed and deformed by the cooling module 100 when the cooling module 100 is mounted to the cabinet 10. When the sealing member 40 is pressed and deformed by the module sealing portion 102 of the cooling module 100, the sealing member 40 may completely fill a gap formed between the cabinet sealing portion 15*a* and the module sealing portion 102. Accordingly, the sealing member 40 may tightly seal the gap between the cabinet 10 and the cooling module 100.

Referring to FIG. 9, silicone oil 45 may be applied to the sealing member 40 to reduce a frictional force with the module sealing portion 102 of the cooling module 100 when the cooling module 100 is mounted. The silicone oil 45 may be applied along an outer surface of the sealing member 40. The silicone oil 45 may also be applied to a surface of the sealing member 40 being in contact with the cabinet sealing portion 15*a*.

Figure 10:
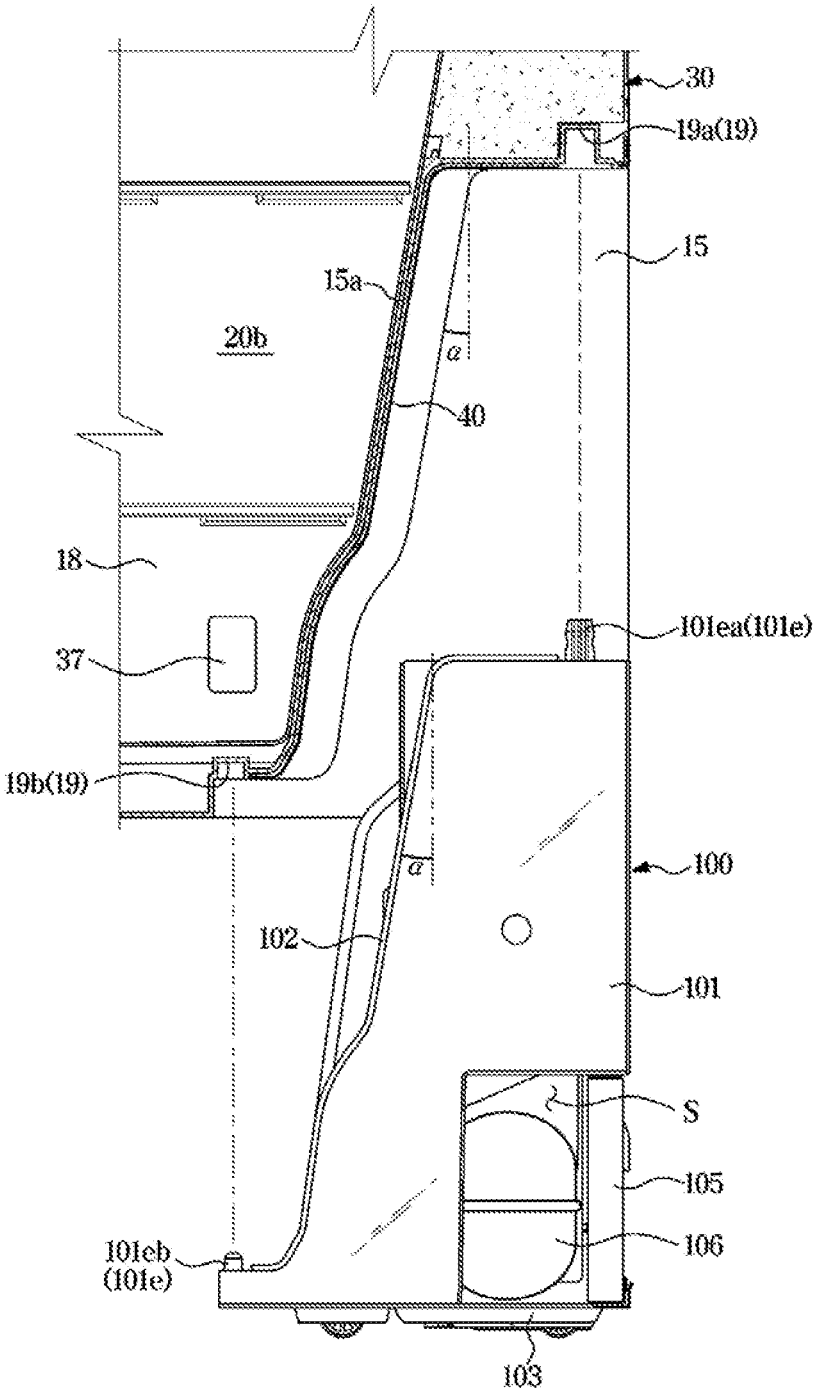
FIGS. 10 and 11 show a state in which the cooling module illustrated in FIG. 2 is mounted to the cabinet.
Figure 11:
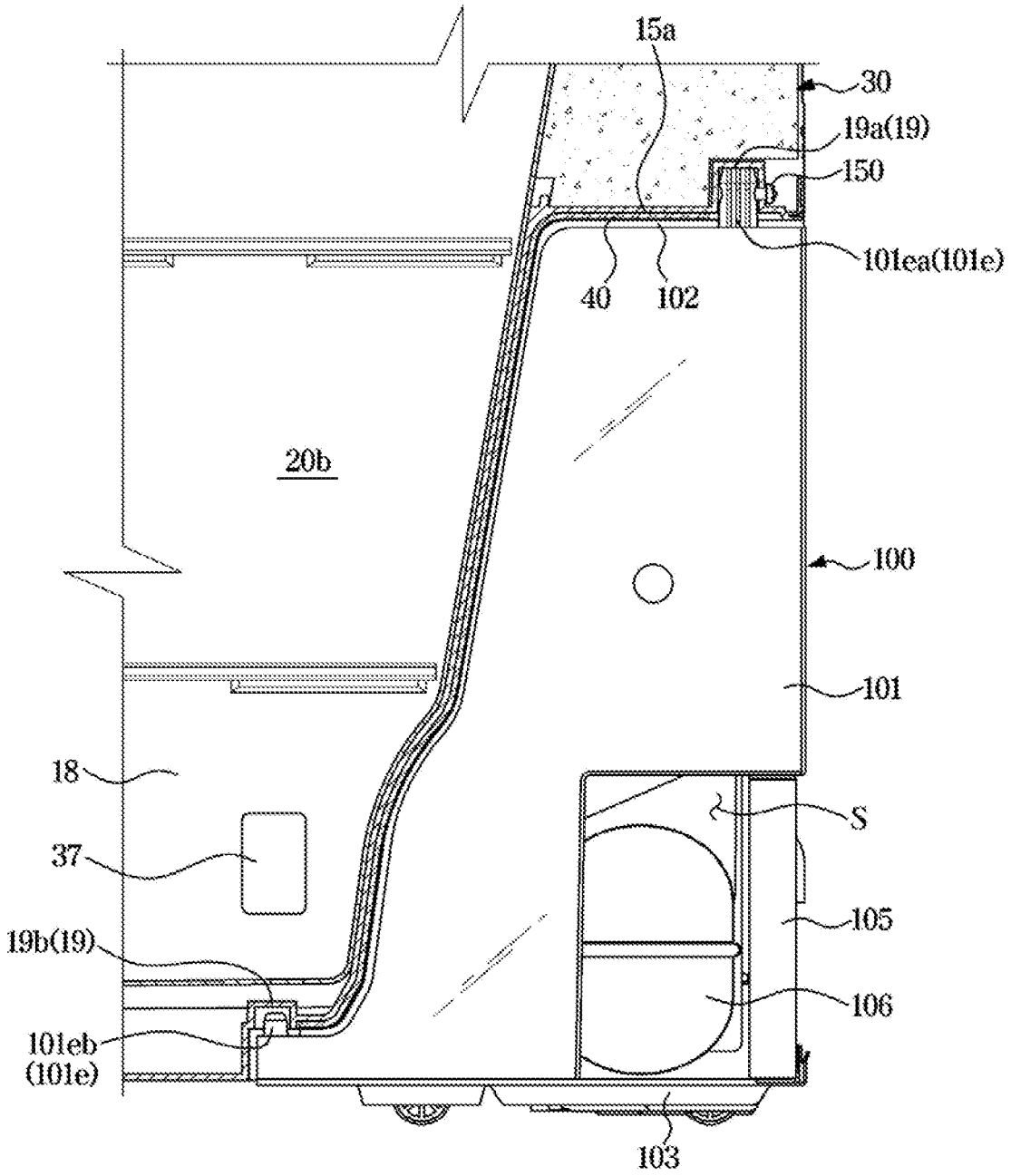

FIGS. 10 and 11 show a state in which the cooling module illustrated in FIG. 2 is mounted to the cabinet.

Referring to FIGS. 10 and 11, at least a portion of the module sealing portion 102 may be inclined with respect to a direction in which the cooling module 100 is mounted to the cabinet 10. At least a portion of the module sealing portion 102 may be positioned at a first angle $\alpha$ with respect to the direction in which the cooling module 100 is mounted to the cabinet 10. At least a portion of the cabinet sealing portion 15*a* may be inclined to correspond to a module inclination portion of the module sealing portion 102. Specifically, the module sealing portion 102 and the cabinet sealing portion 15*a* may be inclined to gradually descend along the direction in which the cooling module 100 is mounted to the cabinet 10.

According to this configuration, the refrigerator 1 according to an embodiment of the disclosure may reduce a friction force that may occur between the cabinet 10, the sealing member 40, and the cooling module 100 when the cooling module 100 is mounted to the cabinet 10. In addition, when the cooling module 100 is mounted to the cabinet 10, the sealing member 40 may be pressed and deformed to fill a gap between the cabinet 10 and the cooling module 100, thereby tightly sealing the gap between the cabinet 10 and the cooling module 100. Further, the sealing member 40 may compensate for errors generated in a manufacturing process of the cabinet 10 and the cooling module 100.

The cabinet 10 may include a module guide 19 for guiding a movement of the cooling module 100 when the cooling module 100 is mounted. The module guide 19 may be in the shape of a groove to allow the mounting guide 101*e* to be inserted therein. The module guide 19 may include at least one first module guide 19*a* formed at an upper portion of the cooling module mounting portion 15 and at least one second module guide 19*b* formed at a lower portion of the cooling module mounting portion 15.

The cooling module 100 may include a mounting guide 101*e* that is guided by the module guide 19 and coupled to the module guide 19 when the cooling module 100 is mounted to the cabinet 10. The mounting guide 101*e* may protrude from the module body 101. The mounting guide 101*e* may include at least one first mounting guide 101*ea* positioned at an upper portion of the module body 101, and at least one second mounting guide 101*eb* positioned at a lower portion of the module body 101.

The number of the first mounting guide 101*ea* and the second mounting guide 101*eb* may correspond to the number of the first module guide 19*a* and the second module guide 19*b*.

The module guide 19 may extend along the direction in which the cooling module 100 is mounted to the cabinet 10. In FIGS. 10 and 11, the cooling module 100 is mounted to the cabinet 10 along the up and down directions, and thus, the module guide 19 may extend along the up and down directions.

The mounting guide 101*e* may extend along the direction in which the cooling module 100 is mounted to the cabinet 10. In FIGS. 10 and 11, the cooling module 100 is mounted to the cabinet 10 along the up and down directions, and thus the mounting guide 101*e* may extend along the up and down directions.

Referring to FIG. 11, the cooling module 100 may further include a fixing member 150 for fixing the mounting guide 101*e* to the module guide 19 when the mounting guide 101*e* is coupled to the module guide 19. The cooling module 100 may be firmly mounted to and fixed to the cabinet 10 by the fixing member 150.

According to this configuration, in the refrigerator 1 according to an embodiment of the disclosure, the cooling module 100 may be stably mounted to the mounting position of the cabinet 10.

Figure 12:
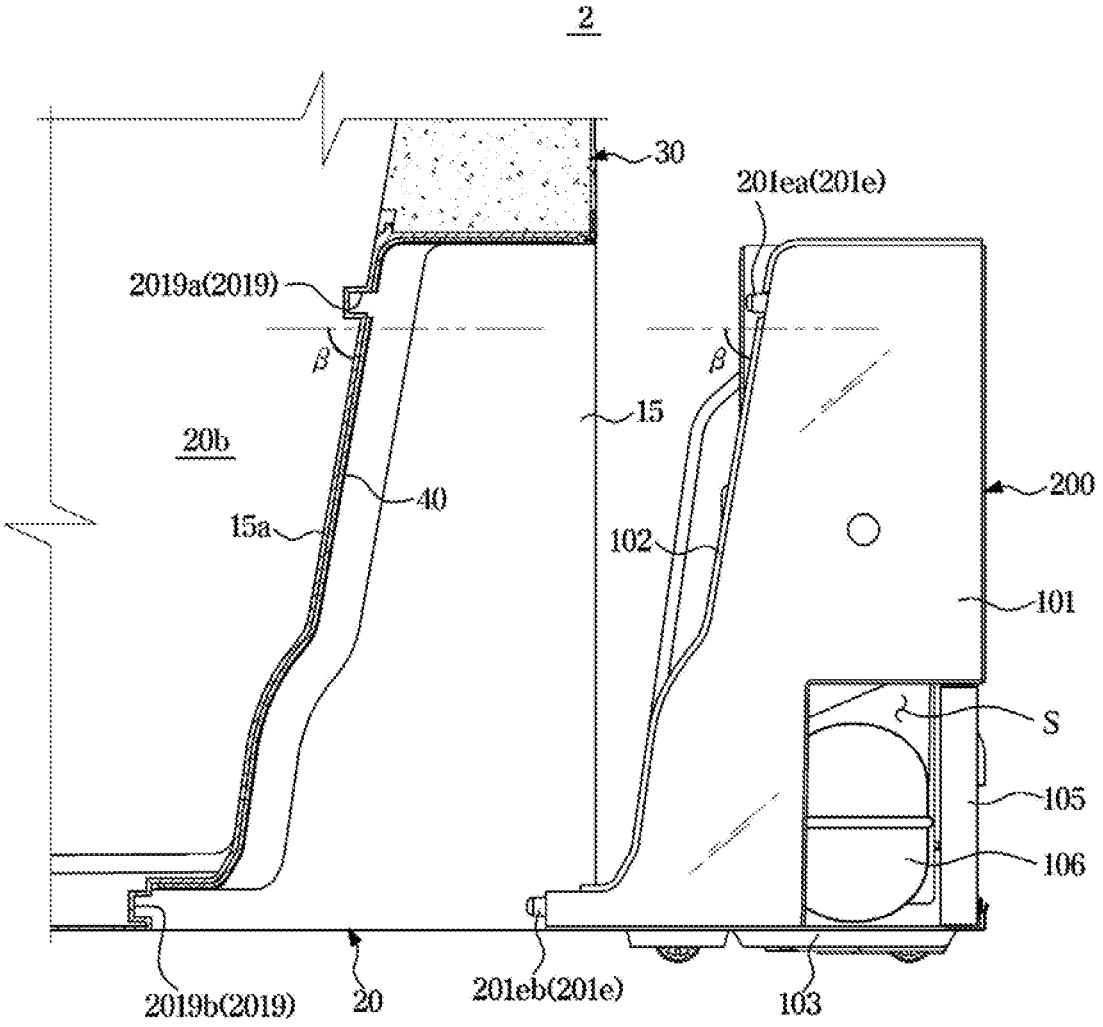
FIG. 12 shows a state in which a cooling module of a refrigerator according to another embodiment of the disclosure is mounted to a cabinet.

FIG. 12 shows a state in which a cooling module of a refrigerator according to another embodiment is mounted to a cabinet.

A refrigerator 2 according to another embodiment of the disclosure will be described below with reference to FIG. 12. In the following description about the refrigerator 2 shown in FIG. 12, the same components of the refrigerator 2 as those of the refrigerator 1 illustrated in FIGS. 1 to 11 will be assigned the same reference numerals, and a detailed description thereof will be omitted.

Referring to FIG. 12, a cooling module 200 may be mounted to a cabinet 20 along the front and rear directions. At least a portion of the module sealing portion 102 and the cabinet sealing portion 15*a* may be positioned at a second angle β with respect to the direction in which the cooling module 200 is mounted. Accordingly, the cabinet 20 may include a module guide 2019 extending in the front and rear directions. The cooling module 200 may include a mounting guide 201*e* extending in the front and rear directions.

The module guide 2019 may include a first module guide 2019*a* positioned at the upper portion of the cooling module mounting portion 15, and a second module guide 2019*b* positioned at the lower portion of the cooling module mounting portion 15. The module guide 2019 may have a groove to allow the mounting guide 201*e* to be inserted therein.

The mounting guide 201*e* may include a first mounting guide 201*ea* positioned at the upper portion of the module body 101, and a second mounting guide 201*eb* positioned at the lower portion of the module body 101. The first mounting guide 201*ea* may be inserted into the first module guide 2019*a*. The second mounting guide 2019*eb* may be inserted into the second module guide 2019*b*. The number of the first mounting guide 201*ea* and the second mounting guide 201*eb* may correspond to the number of the first module guide 2019*a* and the second module guide 2019*b*.

In addition, although not shown, the refrigerator 2 may further include the fixing member 150, as illustrated in FIG. 11, to allow the mounting guide 201*e* of the cooling module 200 to be firmly mounted and fixed to the module guide 2019 of the cabinet 20.

According to this configuration, in the refrigerator 2 according to another embodiment of the disclosure, the cooling module 200 may be stably mounted to the mounting position of the cabinet 20.

As is apparent from the above, according to an idea of the disclosure, because the evaporator of the refrigerator is mounted on the cooling module detachably mounted to the cabinet together with the compressor and the condenser, the cool air supply system may be easily maintained.

According to an idea of the disclosure, because the sealing member is provided between the cabinet and the cooling module, and a surface of the sealing member is inclined with respect to a direction in which the cooling module is mounted when the cooling module is in contact with the cabinet, a gap between the cabinet and the cooling module may be effectively sealed.

The foregoing has illustrated and described specific embodiments. However, it should be understood that the disclosure is not limited to the above-described embodiments, and various changes and modifications may be made without departing from the technical idea of the disclosure described in the following claims.

What is claimed is:

1. A refrigerator comprising:

a cabinet forming a storage chamber therein and including a cooling module mounting and a module guide recessed from an outer surface of the cooling module mounting portion;

a cabinet sealing portion formed on the outer surface of the cooling module mounting portion;

a cooling module detachably mounted to the cooling module mounting portion in a mounting direction that is from a bottom to a top of the cabinet and to accommodate an evaporator, a condenser, and a compressor therein, the cooling module including:

a module housing which includes a module sealing portion facing the cabinet sealing portion, at least a portion of the module sealing portion is positioned at an inclination with respect to the mountings direction in which the cooling module is insertable into the cabinet to be mounted to the cabinet; and a mounting guide protruded from an upper surface of the module housing in the mounting direction, having a shape corresponding to the module guide so that the module guide guides the mounting guide to be coupled to the module guide when the cooling module is inserted into the cabinet in the mounting direction; and a sealing member positioned between the cabinet sealing portion and the module sealing portion under the module guide, wherein a portion of the sealing member is disposed along the upper surface of the module housing such that the portion of the sealing member is disposed between the upper surface of the module housing and a corresponding surface of the cooling module mounting portion facing the upper surface of the module housing when the cooling module is mounted to the cooling module mounting portion.

2. The refrigerator according to claim 1, wherein the cabinet sealing portion comprises a recessed groove, the module sealing portion comprises a protrusion protruding so as to be inserted into the cabinet sealing portion when the cooling module is inserted into the cabinet to be mounted to the cabinet, and the sealing member is inserted into the cabinet sealing portion and pressed by the module sealing portion when the cooling module is inserted into the cabinet to be mounted to the cabinet.

3. The refrigerator according to claim 2, wherein a size of the cabinet sealing portion is larger than a size of the module sealing portion.

4. The refrigerator according to claim 1, wherein the module sealing portion comprises a recessed groove, the cabinet sealing portion comprises a protrusion protruding so as to be inserted into the module sealing portion when the cooling module is inserted into the cabinet to be mounted to the cabinet, and the sealing member is inserted into the module sealing portion and pressed by the cabinet sealing portion when the cooling module is inserted into the cabinet to be mounted to the cabinet.

5. The refrigerator according to claim 4, wherein a size of the module sealing portion is larger than a size of the cabinet sealing portion.

6. The refrigerator according to claim 1, wherein at least one portion of the cabinet sealing portion is inclined to correspond to a module inclination portion of the module sealing portion.

7. The refrigerator according to claim 1, wherein the cabinet comprises a duct opening communicating the cooling module with the storage chamber to receive cool air from the cooling module, and at least a portion of the sealing member extends along an outer circumference of the duct opening.

8. The refrigerator according to claim 1, wherein the module guide comprises a groove to allow the mounting guide to be inserted.

9. The refrigerator according to claim 1, further comprising a fixing member configured to penetrate the module guide to fix the mounting guide to the module guide when the mounting guide is coupled to the module guide.

10. The refrigerator according to claim 1, wherein the module guide and the mounting guide extend along the mounting direction in which the cooling module is insertable into the cabinet to be mounted to the cabinet.

11. The refrigerator according to claim 1, further comprising silicon oil applied to the sealing member.

12. The refrigerator according to claim 1, wherein the module housing comprises:

a module body including an accommodating space in which the evaporator is mounted; and a module insulator provided in the module body such that the accommodating space is insulated from an outside.

13. The refrigerator according to claim 12, wherein the module housing further comprises a base plate positioned below the module body and forming a machine room together with the module body, and the compressor and the condenser are positioned in the machine room.

14. The refrigerator according to claim 12, wherein at least a portion of the module sealing portion is positioned outside the accommodating space along a circumference of the accommodating space.

15. A refrigerator comprising:

a cabinet forming a storage chamber therein and including a cooling module mounting and a module guide recessed from an outer surface of the cooling module mounting portion;

a cabinet sealing portion formed on the outer surface of the cooling module mounting portion;

a cooling module detachably mounted to the cooling module mounting portion in a mounting direction that is from a bottom to a top of the cabinet and including:

a module housing in which an evaporator, a condenser, and a compressor are installed, the module housing includes a module sealing portion interlocking with the cabinet sealing portion and having a size that is different from a size of the cabinet sealing portion; and a mounting guide protruded from an upper surface of the module housing in the mounting direction, having a shape corresponding to the module guide so that the module guide guides the mounting guide to be coupled to the module guide when the cooling module is inserted into the cabinet in the mounting direction; and a sealing member positioned in a gap formed between the cabinet sealing portion and the module sealing portion under the module guide, wherein a portion of the sealing member is disposed along the upper surface of the module housing such that the portion of the sealing member is disposed between the upper surface of the module housing and a corresponding surface of the cooling module mounting portion facing the upper surface of the module housing when the cooling module is mounted to the cooling module mounting portion.

16. The refrigerator according to claim 15, wherein the cooling module is insertable into the cabinet to be mounted to the cabinet, and the cabinet sealing portion or the module sealing portion presses the sealing member when the cooling module is inserted into the cabinet to be mounted to the cabinet.

17. The refrigerator according to claim 15, wherein at least a portion of the cabinet sealing portion and at least a portion of the module sealing portion are inclined with respect to the mounting direction in which the cooling module is insertable into the cabinet to be mounted to the cabinet.

18. The refrigerator according to claim 15, wherein the cooling module comprises a mounting guide extending along the mounting direction in which the cooling module is insertable into the cabinet to be mounted to the cabinet and formed on one surface facing the cabinet.

19. The refrigerator according to claim 15, further comprising silicon oil applied to the cabinet sealing portion or the module sealing portion.

* * * * *